US006604968B2

(12) United States Patent
Wada et al.

(10) Patent No.: US 6,604,968 B2
(45) Date of Patent: Aug. 12, 2003

(54) INTAKE SYSTEM IN V-TYPE 4-STROKE ENGINE FOR OUTBOARD ENGINE SYSTEM

(75) Inventors: Tetsu Wada, Saitama (JP); Tomonori Ikuma, Saitama (JP); Sadafumi Shidara, Saitama (JP); Kazuyoshi Sato, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/073,264

(22) Filed: Feb. 13, 2002

(65) Prior Publication Data

US 2002/0127929 A1 Sep. 12, 2002

(30) Foreign Application Priority Data

Feb. 14, 2001 (JP) ..... 2001-037740
Feb. 14, 2001 (JP) ..... 2001-037744

(51) Int. Cl.[7] ..... B63H 21/10
(52) U.S. Cl. ..... 440/88; 123/195 P
(58) Field of Search ..... 440/88

(56) References Cited

U.S. PATENT DOCUMENTS 5,899,778 A * 5/1999 Hiraoka et al. ..... 440/88
6,450,847 B1 * 9/2002 Kashima et al. ..... 440/88

FOREIGN PATENT DOCUMENTS

JP 10-61446 3/1998

* cited by examiner

*Primary Examiner*—Jesus D. Sotelo
(74) *Attorney, Agent, or Firm*—Arent Fox Kintner Plotkin & Kahn, PLLC

(57) ABSTRACT

An intake system in a V-type 4-stroke engine for an outboard engine system is provided. A crankshaft of the engine is disposed vertically, and heads of left and right banks are disposed to face rearwards. The engine is covered with an engine hood. In the intake system, an intake air inlet is provided in an upper portion of a longitudinally flat intake air dispensing box disposed between the left and right banks and a rear wall of the engine hood, and leads to an intake passageway in a throttle body. The inside of the intake air dispensing box is divided by a partition wall into first and second dispensing chambers communicating with the intake air inlet and extending longitudinally. An on-off valve is mounted on the partition wall and is capable of bringing the first and second dispensing chambers into and out of communication with each other. Intake ports are provided in the left and right banks to communicate with the first and second dispensing chambers, respectively. Thus, it is possible to provide an intake system for a V-type 4-stroke engine in an outboard engine system, in which the air-charging characteristic can be changed in accordance with the operation state of the engine, while avoiding an increase in size of the engine hood.

5 Claims, 16 Drawing Sheets

INTAKE SYSTEM IN V-TYPE 4-STROKE ENGINE FOR OUTBOARD ENGINE SYSTEM

BACKGROUND OF THE INVENTION

1. Field of the Invention

The present invention relates to an intake system in a V-type 4-stroke engine for an outboard engine system, which includes a crankshaft disposed vertically, and heads of left and right banks disposed to face rearwards, and which is covered with an engine hood, and particularly to an intake system in an engine for an outboard engine system, which is designed so that an air-charging characteristic can be changed in accordance with the operational state of the engine to maintain a high power output performance in a wide operation range from a low speed to a high speed.

2. Description of the Related Art

There is an intake system in an engine for an outboard engine system, which is known, for example, from Japanese Patent Application Laid-open No.10-61446 and in which the effective length of an intake line is changed over in accordance with the operational state of the engine to satisfy the power output performance in a wide operation range.

However, in the system disclosed in the above Patent Publication, an intake pipe extending in a longitudinal direction is disposed on one side in a lateral direction of the engine. Therefore, an engine hood including the intake pipe and covering the engine is necessarily increased in width, inevitably resulting in an increase in size of the engine hood. This tendency is significant particularly when such intake system is applied to a V-type 4-stroke engine.

SUMMARY OF THE INVENTION

The present invention has been achieved with the above circumstances in view, and it is an object of the present invention to provide an intake system for a V-type 4-stroke engine for an outboard engine system, wherein the air-charging characteristic is changed in accordance with the operational state of the engine to maintain a high power output performance in a wide operation range of from a low speed to a high speed, while avoiding an increase in size of the engine hood.

To achieve the above object, according to a first aspect and feature of the present invention, there is provided an intake system in a V-type 4-stroke engine for an outboard engine system, the engine including a crankshaft disposed vertically, and cylinder heads of left and right banks disposed to face rearwards, and an engine hood covering the engine. The intake system comprises an intake air inlet which is provided in an upper portion of a longitudinally flat intake air dispensing box disposed between the cylinder heads and a rear wall of the engine hood and which leads to an intake passageway in a throttle body, the inside of the intake air dispensing box being divided by a partition wall into first and second dispensing chambers each communicating with the intake air inlet and extending longitudinally; and an on-off valve mounted on the partition wall and capable of bringing the first and second dispensing chambers into and out of communication with each other. Each of the left and right banks has an intake port which communicates with the first and second dispensing chambers.

With the first feature, a two-line resonant supercharging intake system, which comprises an intake line extending from the first dispensing chamber to the intake port in the left bank and an intake line extending from the second dispensing chamber to the intake port in the right bank, and in which no charging interference of the lines with each other is produced, is constituted by closing the on-off valve in a low-speed operation range of the engine to bring the first and second dispensing chambers out of communication with each other. The peculiar vibration of the two-line resonant supercharging intake system is set to be substantially equal to an opening/closing cycle of the intake valve in the low-speed operation range of the engine, whereby a resonant supercharging effect can be effectively exhibited to increase the intake air charging efficiency in the low-speed operation range of the engine to enhance the power output performance.

A single surge tank having a large capacity is constituted by opening the on-off valve in a high-speed operation range of the engine to bring the first and second dispensing chambers into a large communication with each other. Thus, the peculiar frequency of the resonant intake system is increased to correspond to the opening/closing cycle of the intake valve in each of the banks in the high-speed operation range of the engine, whereby the resonant supercharging effect can be exhibited to increase the intake air charging efficiency in the high-speed operation range of the engine to enhance the power output performance.

Moreover, the longitudinally flat intake air dispensing box is disposed in proximity to the heads of the left and right banks and hence, the intake air dispensing box can be disposed in a narrow space between the engine and the rear wall of the engine hood. Thus, it is possible to provide an improvement in space utilization efficiency in the engine room and to suppress an increase in size of the engine hood.

According to a second aspect and feature of the present invention, in addition to the first feature, an opening is provided in one sidewall of the intake air dispensing box; a lid plate having the partition wall is secured to the intake air dispensing box to close the opening; and the on-off valve is mounted to the partition wall of the lid plate.

With the second feature, the intake air dispensing box provided with the on-off valve can be assembled with a good efficiency by constructing an assembly of the lid plate and the on-off valve and then securing the lid plate to the intake air dispensing box.

According to a third aspect and feature of the present invention, in addition to the first or second feature, the intake air dispensing box having the intake air inlet is formed of a synthetic resin, and a plurality of intake branches made of a synthetic resin and leading at their downstream ends to a plurality of intake ports in the engine are connected to the sidewall of the intake air dispensing box, funnels are formed at the upstream ends of the intake branches and disposed within the intake air dispensing box, thereby constructing an intake manifold. The intake air dispensing box is comprised of a first box half and a second box half welded to each other on one plane, the intake air inlet being provided in one of the box halves. Plurality of the intake branches are comprised of a plurality of intake branch bodies integrally formed on the first box half and each having a portion of each of the funnels, and a plurality of funnel segments welded to said intake branch bodies on one plane in the intake air dispensing box and each constituting the remaining portion of each of the funnels.

With the third feature, the formation of each of the components of the intake manifold can be facilitated, and when the components are welded together, the pressing force on all the weld surfaces is equalized reliably, thereby equalizing the weld margin and providing the stabilization of the weld strength. Thus, it is possible to improve productivity and quality of the intake manifold.

According to a fourth aspect and feature of the present invention, in addition to the third feature, a connector is integrally formed on the plurality of funnel segments and connects the funnel segments together.

With the fourth feature, it is possible to form the plurality of funnel segments along with the connector at a stroke and to easily conduct the vibration welding of them to the intake branch bodies.

According to a fifth aspect and feature of the present invention, in addition to the third feature, a plane on which the first and second box halves are welded to each other and a plane on which the intake branch bodies and the funnel segments are welded to each other, are disposed on one plane.

With the fifth feature, it is possible to further enhance the productivity of the intake manifold.

The above and other objects, features and advantages of the invention will become apparent from the following description of the preferred embodiment taken in conjunction with the accompanying drawings.

DESCRIPTION OF THE PREFERRED EMBODIMENT

The present invention will now be described by way of an embodiment with reference to the accompanying drawings. The terms "front, rear, left and right" in the flowing description are represented with respect to a hull H to which an outboard engine system O is mounted.

Figure 1:
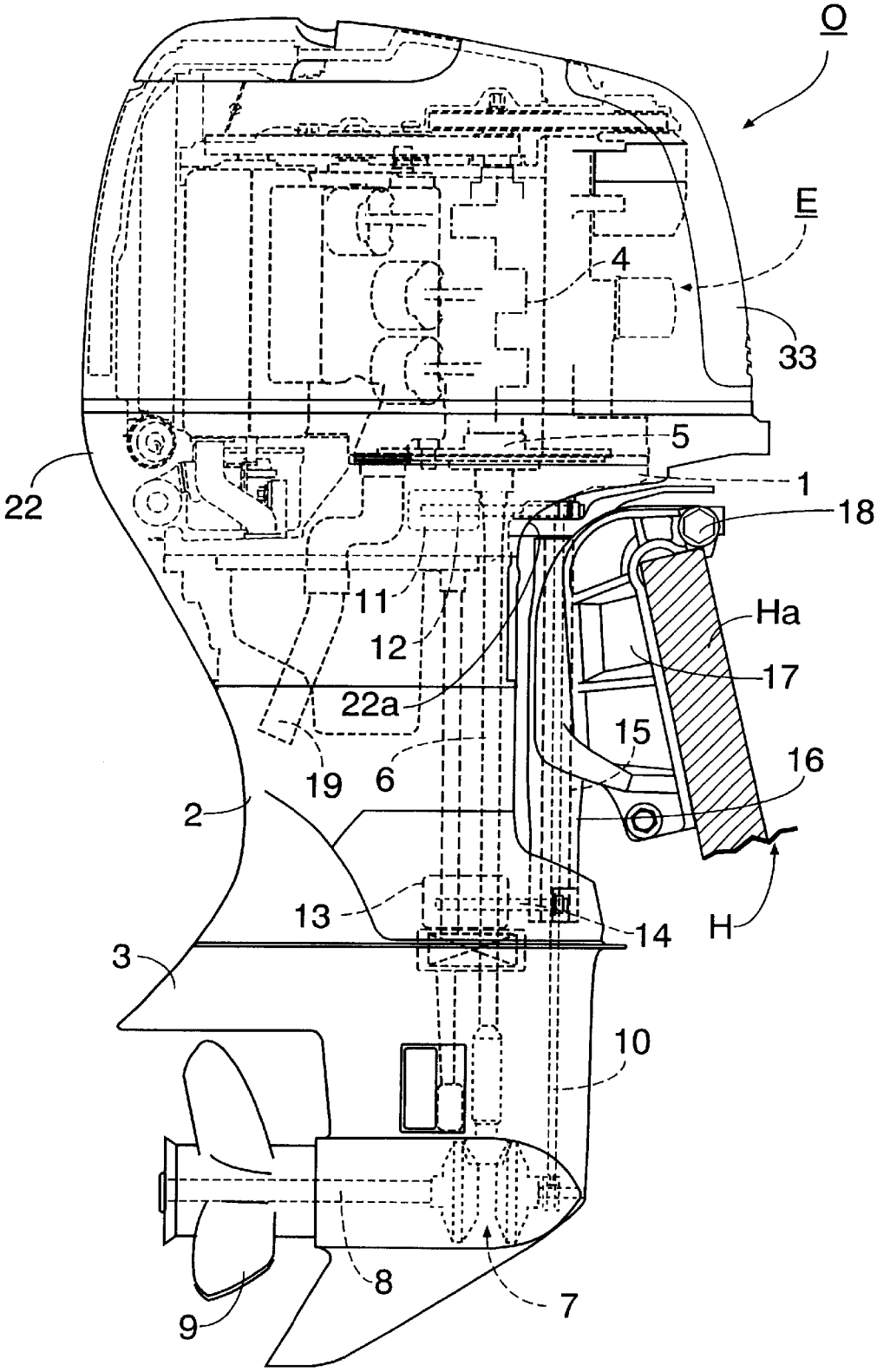
FIG. 1 is a side view of the entire arrangement of an outboard engine system.
Figure 2:
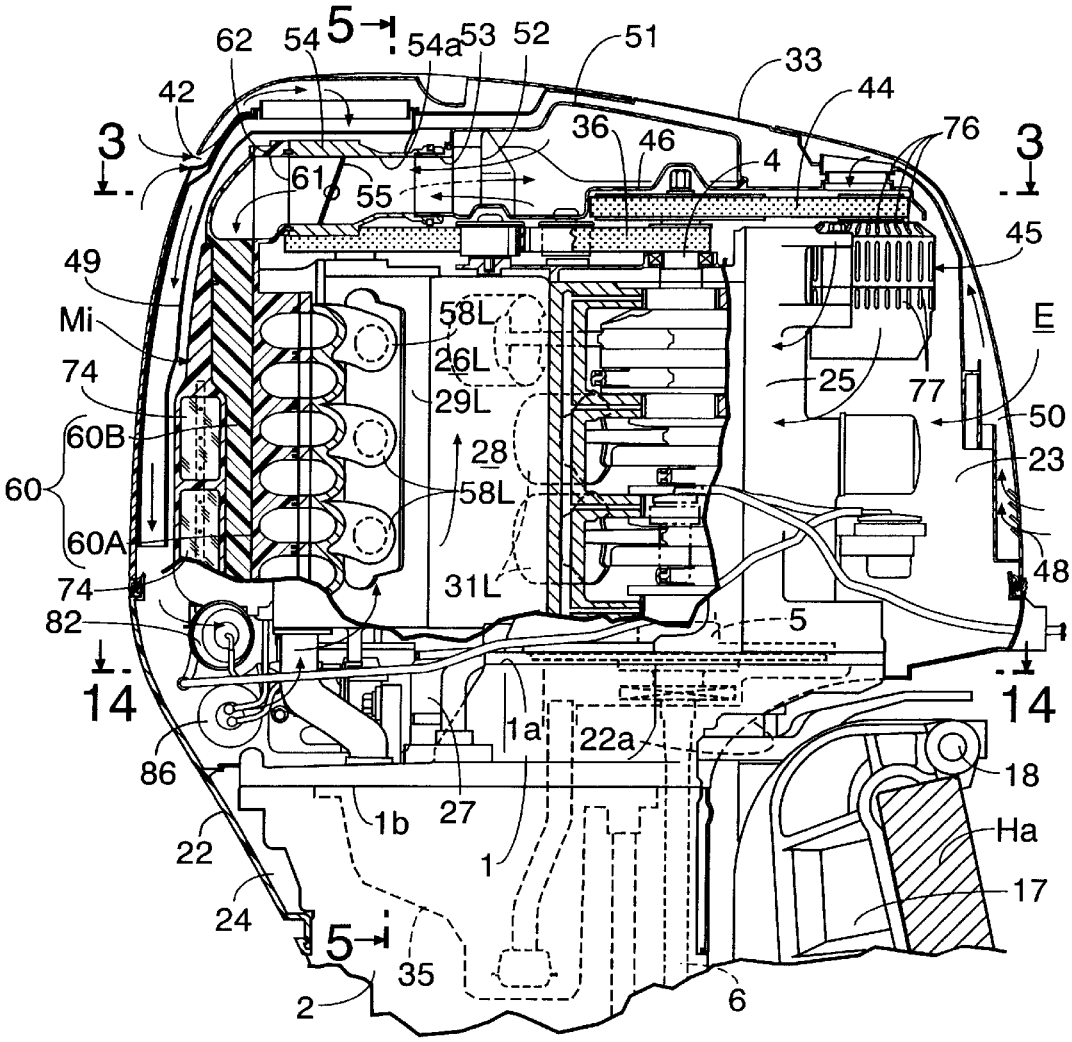
FIG. 2 is a vertical sectional view of an essential portion in FIG. 1.

Referring to FIGS. 1 and 2, an outboard engine system O includes a mount case 1, an extension case 2 coupled to a lower end face of the mount case 1, and a gear case 3 coupled to a lower end face of the extension case 2. A V-type 6-cylinder water-cooled 4-stroke engine E is mounted on an upper end face of the mount case 1 with its crankshaft 4 disposed vertically.

A drive shaft 6 is connected, along with a flywheel 5, to a lower end of the crankshaft 4. The crankshaft 4 extends downwards within the extension case 2 and is connected at its lower end to a horizontal propeller shaft 8 through a forward/backward movement changeover mechanism 7 mounted within the gear case 3, and a propeller 9 is secured to a rear end of the propeller shaft 8. A changing rod 10 is connected to a front portion of the forward/backward movement changeover mechanism 7 for operating the forward/backward movement changeover mechanism 7.

A swivel shaft 15 is fixed between a pair of left and right upper arms 12 each connected to the mount case 1 through an upper mount rubber 11 and a pair of left and right lower arms 14 each connected to the extension case 2 through a lower mount rubber 13. A swivel case 16 supporting the swivel shaft 15 for rotation is vertically swingably supported on a stern bracket 17 mounted on a transom Ha of the hull H through a horizontal tilting shaft 18.

A bracket 20 is mounted to the mount case 1 through a plurality of stays 21 to surround a lower portion of the engine E, and an annular undercover 22 made of a synthetic resin is secured to the bracket 20. The undercover 22 surrounds a section from the lower portion of the engine E to an upper portion of the extension case 2, and an engine hood 33 is detachably mounted at an upper end of the undercover 22 to cover the engine E from above. An engine room 23 for accommodation of the engine E is defined by the engine hood 33 and the undercover 22. The undercover 22 defines an annular empty chamber 24 between the undercover 22 and an outer peripheral surface of an upper portion of the extension case 2. The undercover 22 has a notch 22*a* at a front portion thereof for opening the empty chamber 24 to the atmospheric air, and the upper arms 12 are disposed through the notch 22*a*.

Figure 3:
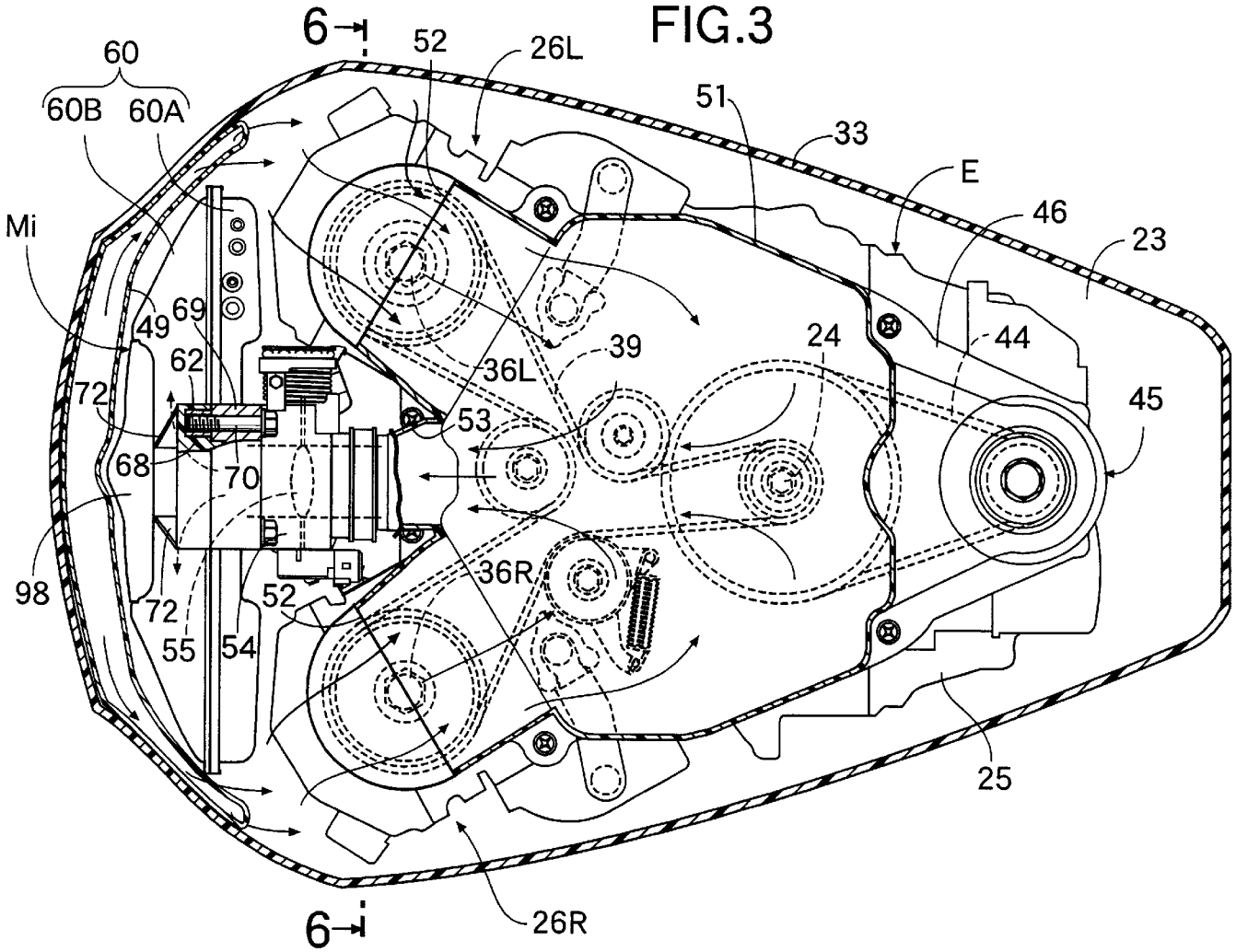
FIG. 3 is a sectional view taken along a line 3—3 in FIG. 2.
Figure 4:
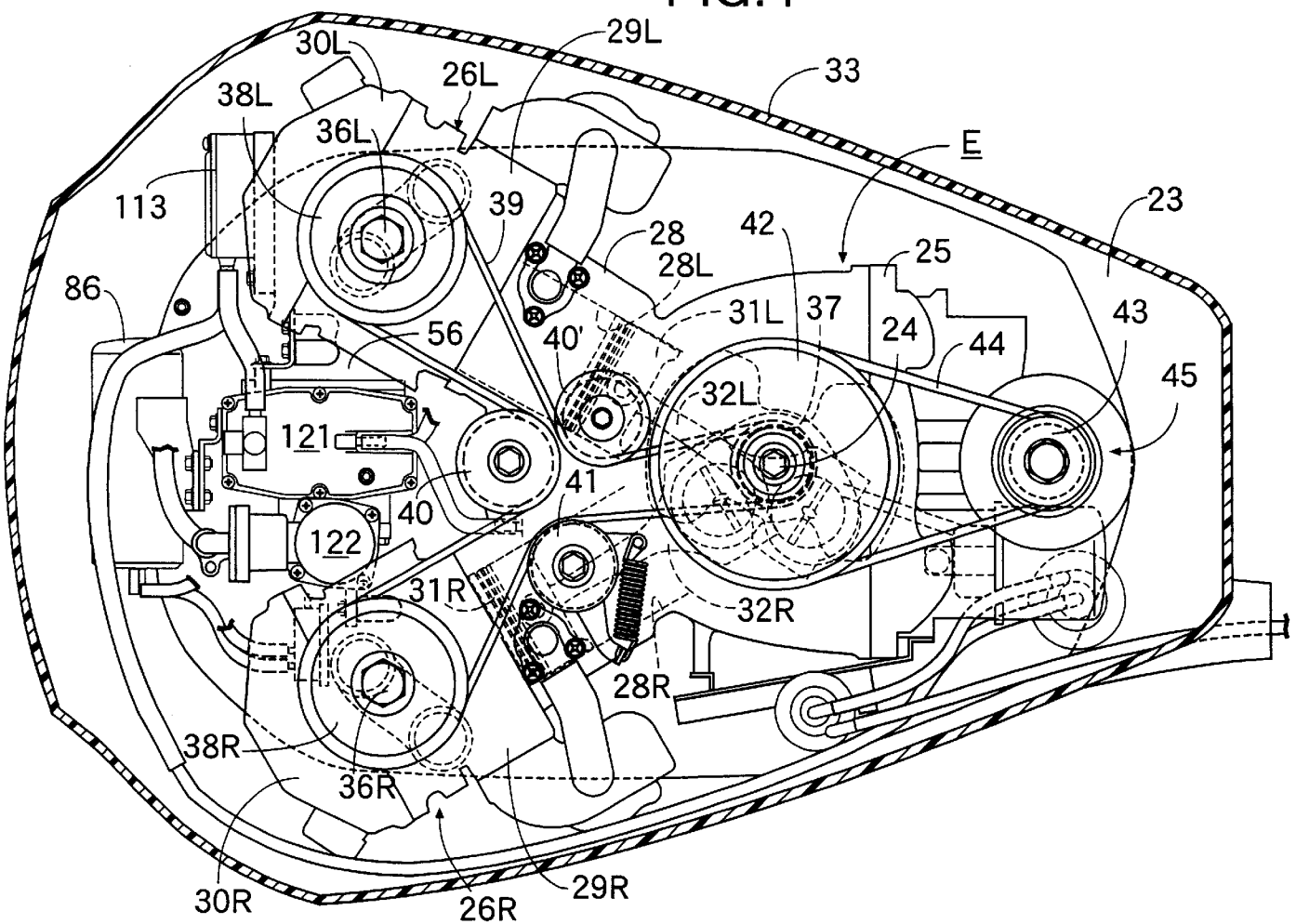
FIG. 4 is a plan view similar to FIG. 2, but showing a state in which an intake system is eliminated.
Figure 14:
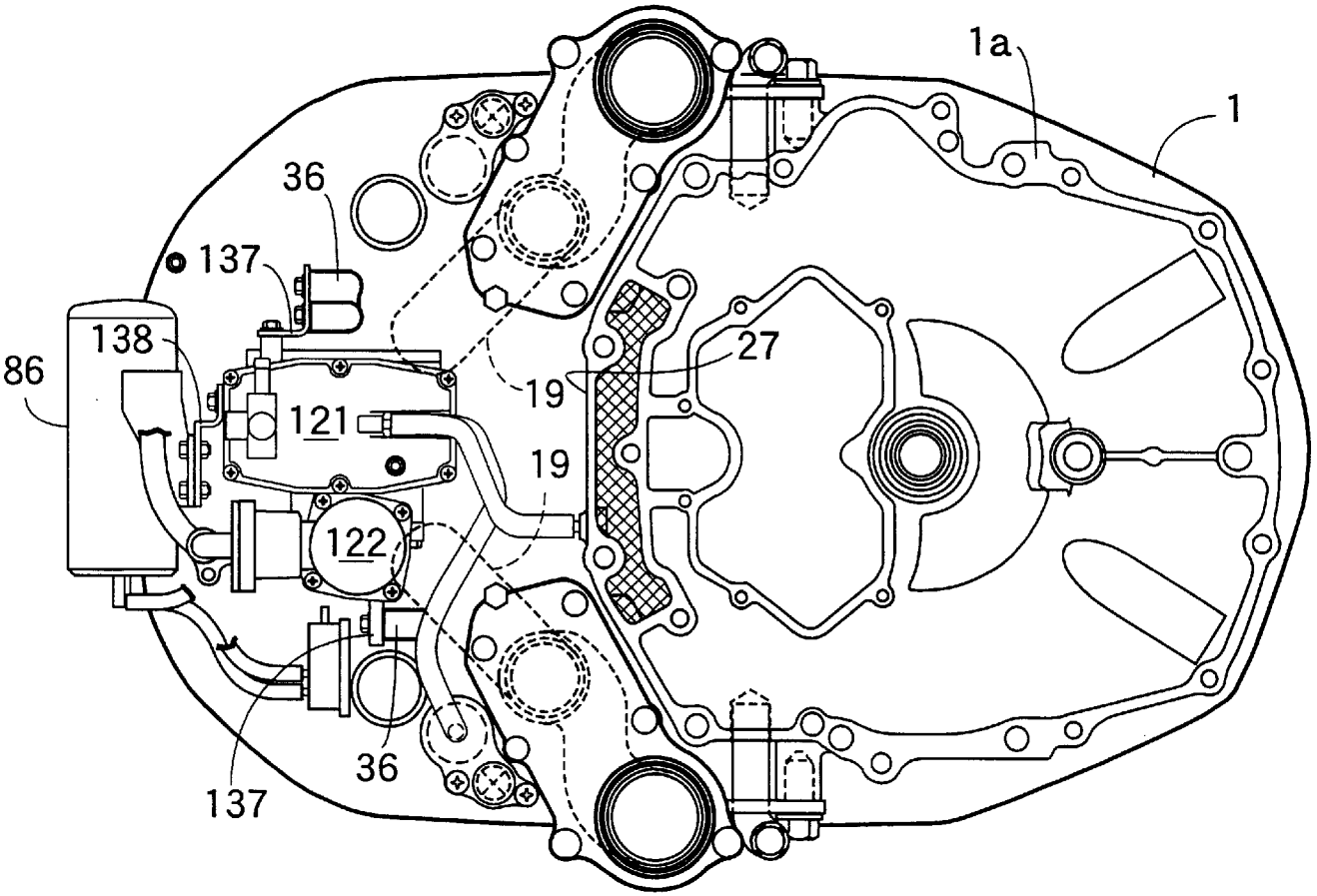
FIG. 14 is a view taken along a line 14—14 in FIG. 2.
Figure 15:
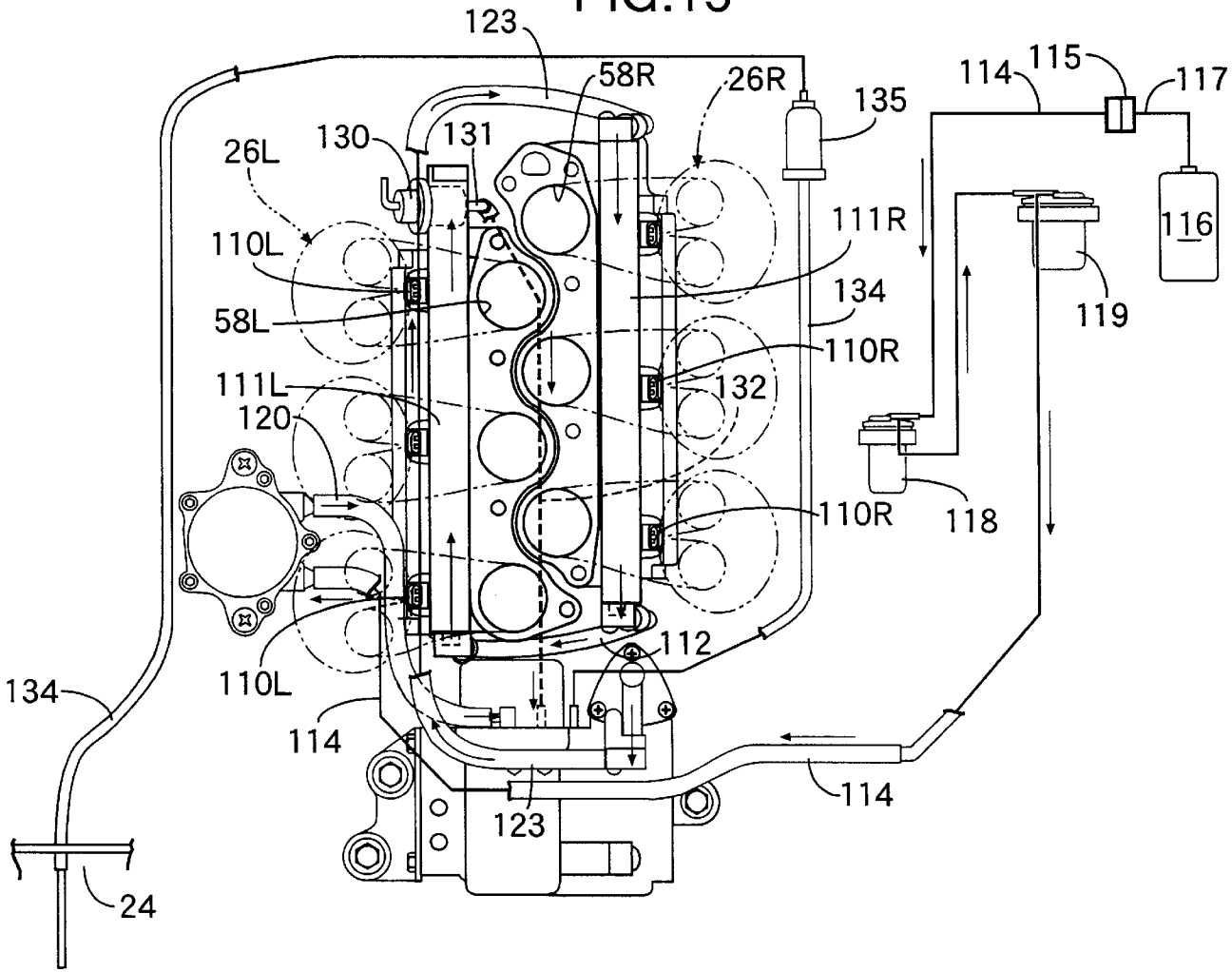
FIG. 15 is a diagram showing the entire fuel supply system.

As shown in FIGS. 2 to 4, the engine E includes a crankcase 25 adapted to support the crankshaft 4 disposed vertically, and a pair of left and right banks 26L and 26R spread rearwards from the crankcase 25 into a V-shape. A lower surface of the crankcase 25 is bolted to a mounting face 1*a* (see FIG. 14) of an upper portion of the mount case 1. An auxiliary-placing space 27 is formed in the mount case 1 at a level higher than the other upper surface and in a forward offset manner, and thus defined between the left and right banks 26L and 26R and the mount case 1.

Figure 5:
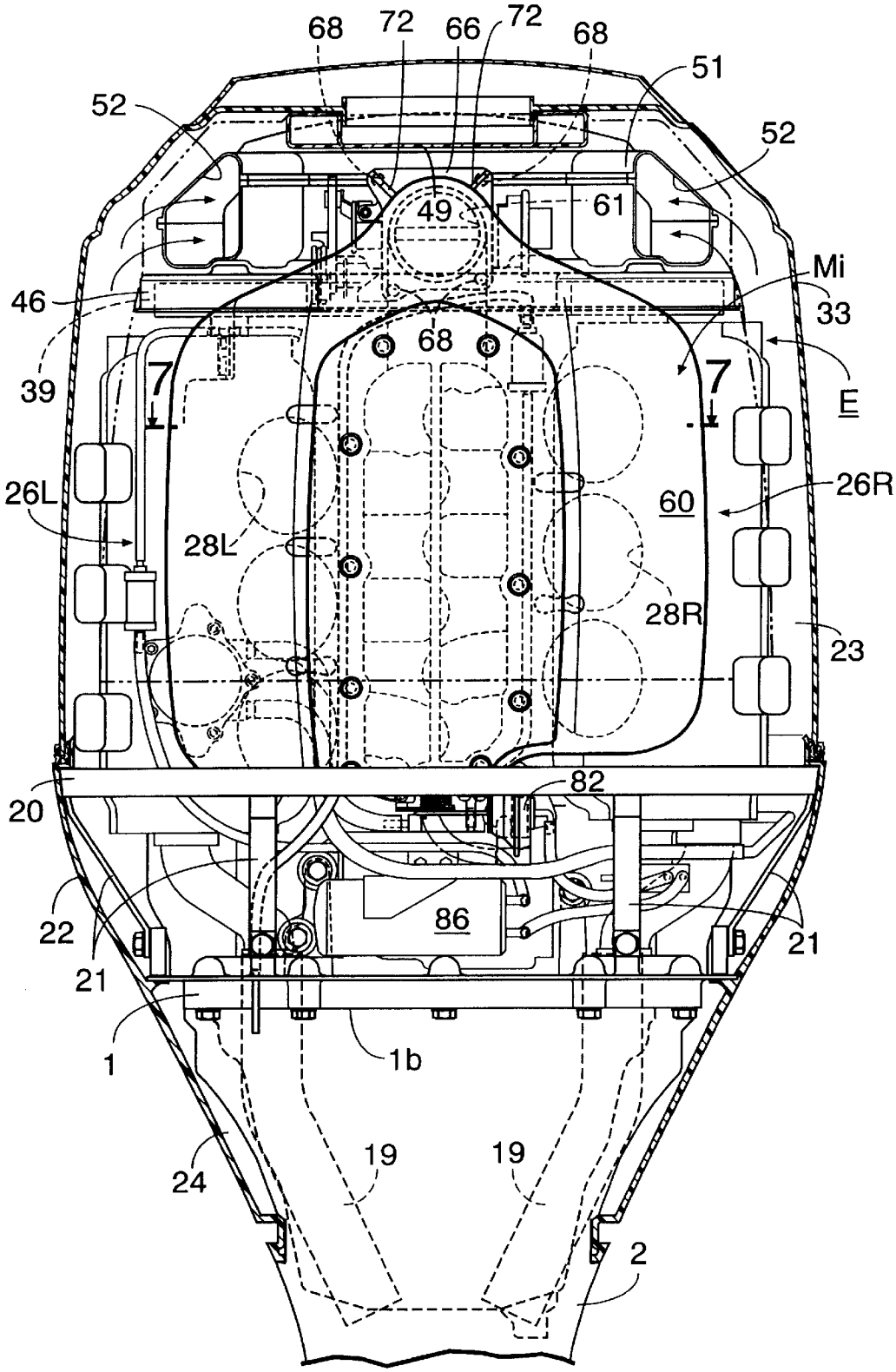
FIG. 5 is a sectional view taken along a line 5—5 in FIG. 2.
Figure 6:
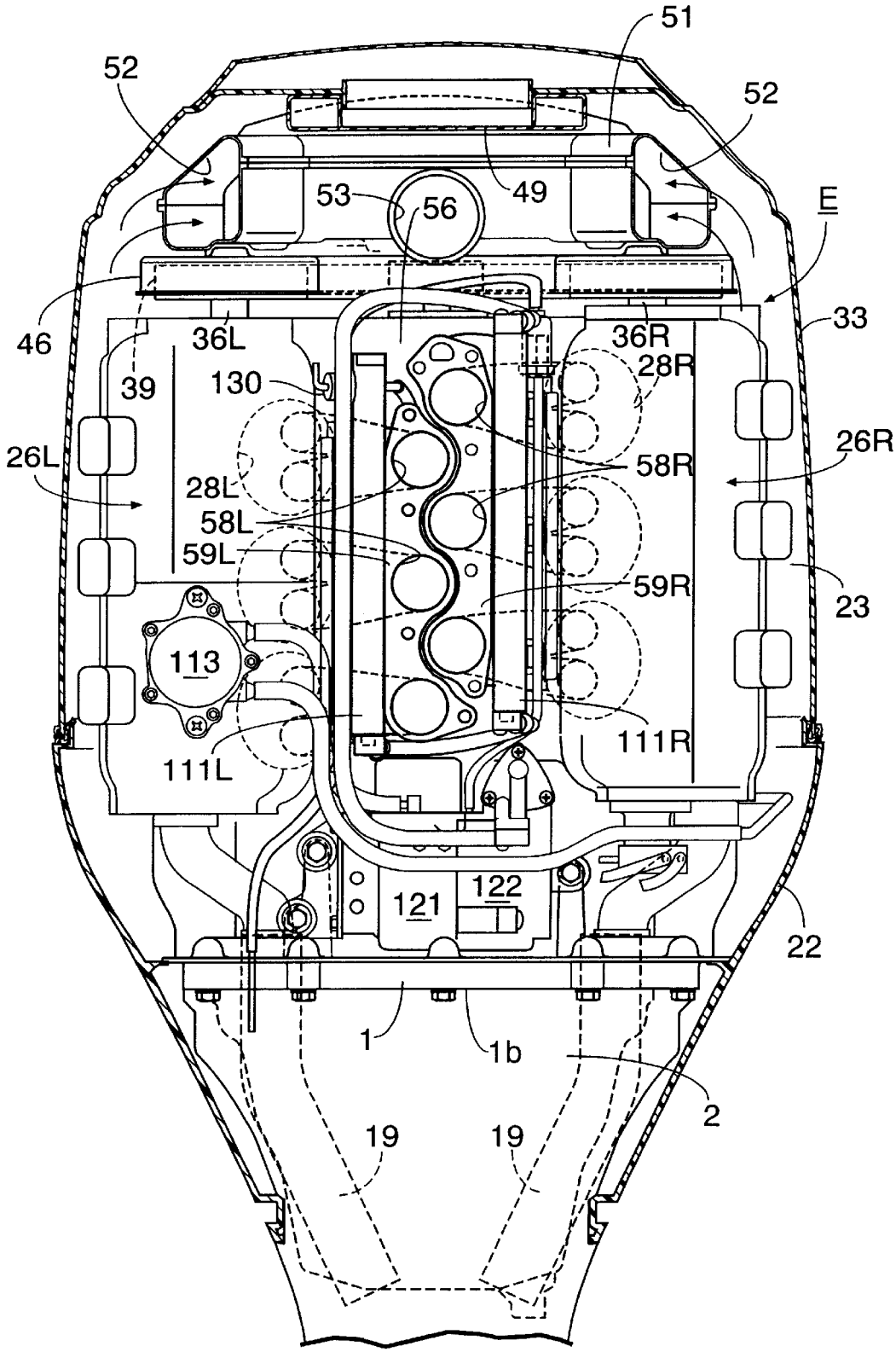
FIG. 6 is a sectional view taken along a line 6—6 in FIG. 3.

As shown in FIGS. 5 and 6, each of the banks 26L and 26R includes a plurality of (three in the illustrated embodiment) cylinder bores 28L, 28R arranged vertically. The left and right banks 26L and 26R are bolted to a rear end face of the crankcase 25, and has cylinder blocks 28 having the left and right cylinder bores 28L and 28R; a pair of cylinder heads 29L and 29R bolted to left and right end faces of the cylinder block 28, into which the cylinder bores 28L and 28R open respectively; and a pair of head covers 30L and 30R coupled to rear end faces of the cylinder heads 29L and 29R to close valve-operating chambers defined in the cylinder heads 29L and 29R.

Referring to FIG. 4, pistons 31L and 31R slidably received in the cylinder bores 28L and 28R are connected to the crankshaft 4 through connecting rods 32L and 32R, respectively.

An oil pan 35 disposed in the extension case 2 is coupled to a mounting face 1*b* of a lower portion of the mount case 1.

Valve-operating camshafts 36L and 36R parallel to the crankshaft 4 are rotatably supported on the left and right cylinder heads 29L and 29R. A first drive pulley 37 of a smaller-diameter is secured to an upper end of the crankshaft 4, and follower pulleys 38L and 38R are secured to upper ends of the left and right camshafts 36L and 36R. A single timing belt 39 is reeved around the drive and follower pulleys 37, 38L and 38R, so that the first drive pulley 37 drives the follower pulleys 38L and 38R and thus the camshafts 36L and 36R at a reduction ratio of ½ during rotation of the crankshaft 4. Disposed between the pulleys 37 and 38L, 38R are idle pulleys 40 and 40' for guiding the timing belt 39, and a tensioner pulley 41 for tensioning the timing belt 39 while guiding the timing belt 39.

A second drive pulley 42 of a larger diameter disposed coaxially immediately above the first drive pulley 37 is also secured to the upper end of the crankshaft 4. A drive belt 44 is reeved around the second drive pulley 42 and a follower pulley 43 of a generator 45 mounted to a front surface of the crankcase 25, so that the second drive pulley 42 drives the follower pulley 43 and thus the generator 45 at an increased speed during rotation of the crankshaft 4.

As shown in FIGS. 2 and 3, a belt cover 46 is secured to upper surfaces of the cylinder block 28 and the crankcase 25 to cover the timing belt 39 and the drive belt 44 from above.

Reference numeral 29 in FIG. 1 denotes an exhaust pipe leading to an exhaust port of the engine E and opens at its downstream end into the extension case 2. An exhaust gas discharged from the exhaust pipe 19 into the extension case 2 is passed through a hollow portion of a boss of the propeller 9 and discharged into water.

An intake system in the engine will be described below with reference to FIGS. 2, 3 and 5 to 13.

Referring to FIGS. 2 and 3, a first air intake port 47 is provided in an upper portion of a rear surface of the engine hood 33, and a flat ventilating duct 49 is disposed along an inner surface of a rear wall of the engine hood 33 to open at its lower end into a lower portion of the engine room 23. A second air intake port 48 is provided in a lower portion of a front surface of the engine hood 33, and a partition wall 64 is mounted to an inner surface of a front wall of the engine hood 33 to define a ventilating passage 50 extending from the second air intake port 48 to an upper portion of the generator 45.

A box-shaped intake silencer 51 is connected to an upper surface of the belt cover 46 and utilizes a portion of a rear half of the upper surface of the belt cover 46 as a portion of a bottom wall. The intake silencer 51 is provided at its rear wall with a pair of left and right inlets 52, 52, and an outlet 53 disposed between the inlets 52, 52, and an intake passageway 54*a* in a throttle body 54 is connected at its upstream end to the outlet 53. A throttle valve 55 is supported in the intake passageway 54*a* for operation in association with an accelerator lever (not shown) mounted on the hull H.

Figure 7:
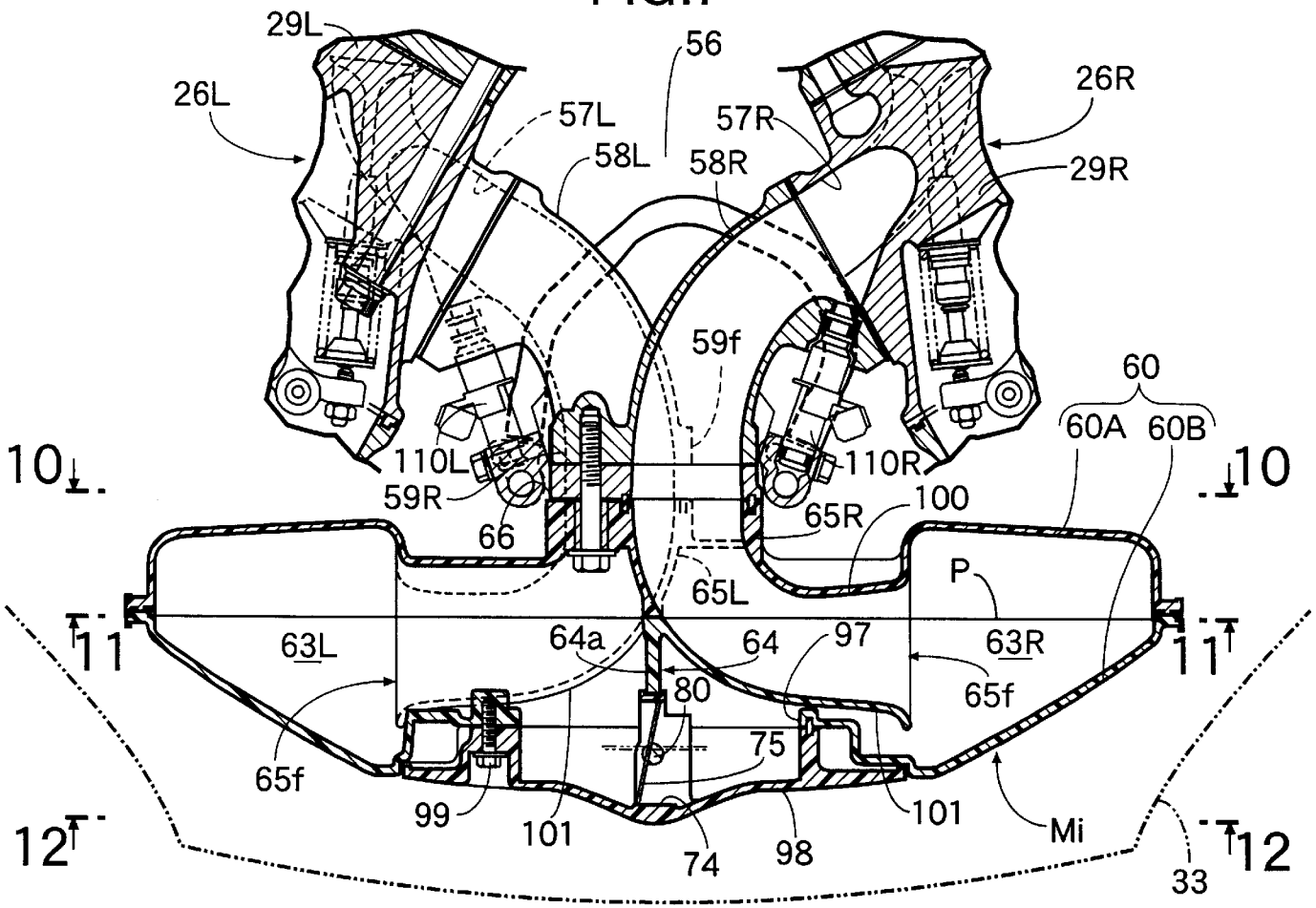
FIG. 7 is a sectional view taken along a line 7—7 in FIG. 5.

Referring to FIGS. 5 to 7, an intake manifold Mi is disposed to face a valley 56 between the left and right banks 26L and 26R and connected to a downstream end of the intake passageway 54*a* in the throttle body 54. A plurality of left intake pipes 58L connected to a plurality of intake ports 57L defined in the cylinder head 29L of the left bank 26L and a plurality of right intake pipes 58R connected to a plurality of intake ports 57R defined in the cylinder head 29R of the right bank 26R are disposed in the valley 56 in such a manner that their upstream ends are turned rearwards. A left connecting flange 59L is integrally formed at upstream ends of the plurality of left intake pipes 58L for connecting the left intake pipes 58L to one another, and a right connecting flange 59R is integrally formed at upstream ends of the plurality of right intake pipes 58R for connecting the right intake pipes 58R to one another.

The intake manifold Mi includes an intake air dispensing box 60 made of a synthetic resin and having a vertically elongated and longitudinally flat shape. The intake air dispensing box 60 is disposed astride rear surfaces of the left and right banks 26L and 26R. A connecting flange 62 is formed at an upper portion of a front wall of the intake air dispensing box 60 and has an intake air inlet 61 at its central portion, and a vertically extending partition wall 64 is provided within the intake air dispensing box 60, whereby the inside of the intake air dispensing box 60 is divided into a left dispensing chamber 63L and a right dispensing chamber 63R each communicating with the intake air inlet 61. A guide wall 67 is connected to the partition wall 64 for diverting air flowing in the intake air inlet 61 into the left and right dispensing chambers 63L and 63R.

A plurality of left intake branches 65L and a plurality of right intake branches 65R are integrally formed on a front wall facing the valley 56 of the intake air dispensing box 60 to communicate with the left and right dispensing chambers 63L and 63R, respectively. A single connecting flange 66 is integrally formed at downstream ends of the pluralities of left and right intake branches 65L and 65R to connect the left and right intake branches 65L and 65R to each other. The connecting flange 66 is bolted to the connecting flanges 59L and 59R of the left and right intake pipes 58L and 58R.

A funnel 65*f* is formed at an upstream end of each of the left intake branches 65L to open leftward into the intake air dispensing box 60, and a funnel 65*f* is formed at an upstream end of each of the right intake branches 65R to open rightward into the intake air dispensing box 60. Each of the funnels 65*f* contributes to a reduction in line resistance, while ensuring an effective length of the corresponding intake branch 65L, 65R.

Referring to FIGS. 3, 7 to 9 and 10, the connecting flange 62 having the intake air inlet 61 has a polygonal shape (a quadrangular shape in the illustrated embodiment), and a nut 68 is embedded in each of corners of the connecting flange 62. A connecting flange 69 formed at the downstream end of the throttle body 54 is superposed on a front end face of the connecting flange 62, and a plurality of bolts 70 inserted through the connecting flange 69 are threadedly fitted over the nuts 68, whereby the connecting flanges 62 and 69 are coupled to each other.

A plurality of lightening recesses 71 are defined in the front end face of the connecting flange 62, and a plurality of ribs 72 are integrally formed on a back of the connecting flange 62 to extend on an outer surface of the intake air dispensing box 60. With such arrangement, it is possible to reinforce a neck portion of the connecting flange 62, while providing a reduction in weight of the connecting flange 62. Particularly, the arrangement of the reinforcing ribs 72 at locations corresponding to the embedded nuts 68 is effective for effectively reinforcing the connection of the connecting flange 62 with the throttle body 54.

The partition wall 64 dividing the inside of the intake air dispensing box 60 into the left and right dispensing chambers 63L and 63R is provided with a single or a plurality of valve bores 74 providing a direct communication between the dispensing chambers 63L and 63R, and a single or a plurality of on-off valves 75 for opening and closing the valve bores 74 are supported on the partition wall 64.

Thus, during operation of the engine E, air flowing into the first air intake port 47 flows down in the ventilating duct 49; is released into the lower portion of the engine room 23; and flows toward the left and right inlets 52, 52 in the intake silencer 51 mounted at an upper location. At that time, water drops contained in the air are separated from the air and dropped and hence, can be prevented from entering the intake silencer 51.

On the other hand, during driving of the generator 45, a cooling fan in the generator 45 is rotated and hence, the air flowing into the second air intake port 48 flows upwards in the ventilating passage 50 to enter a cooling-air inlet 76 in an upper portion of the generator 45, cools the inside of the generator 45 and then flows out of a cooling-air outlet 77 in a lower portion of the generator 45. Thereafter, the air flows toward the left and right inlets 52, 52 in the intake silencer 51.

The airflows entering the left and right inlets 52, 52 join with each other in the intake silencer 51 and exit from the outlet 53. Then, this air flows through the intake passageway 54*a* of the throttle body 54 toward the intake air inlet 61 in the intake air dispensing box 60. In this process, the amount of air drawn into the engine E is controlled in the intake passageway 54*a* in accordance with the opening degree of the throttle valve 55.

In a low-speed operation range of the engine E, the on-off valve 75 in the intake air dispensing box 60 is in a closed state, and the air flowing into the intake air inlet 61 is diverted into the left and right dispensing chambers 63L and 63R extending vertically. The air diverted into the left dispensing chamber 63L is further diverted into the plurality of left intake branches 65L, and the resulting airflows are passed via the left intake pipes 58L and through the intake ports 57L in the left bank 26L and drawn into the corresponding cylinder bores 27L. The air diverted into the right dispensing chamber 63R is further diverted into the plurality of right intake branches 65R, and the resulting airflows are passed via the right intake pipes 58R and through the intake ports 57R in the right bank 26R and drawn into the corresponding cylinder bores 27R.

In the low-speed operation range of the engine E, the left dispensing chamber 63L and the right dispensing chamber 63R, into which the funnels 65*f* of the left and right intake air branches 65L and 65R open, are shut off by the on-off valve 75 in the closed state, excluding their portions communicating with the intake air inlet 61 provided at the upper location, thereby constructing a two-line resonant supercharging intake system, which comprises an intake line extending from the left dispensing chamber 63L to the intake air port 57L in the left bank 26L and an intake line extending from the right dispensing chamber 63R to the intake air port 57R in the right bank 26R, wherein no charging interference of the lines with each other is produced. Moreover, the peculiar vibration of the two-line resonant supercharging intake system is set to be substantially equal to an opening/closing cycle for the intake valve in each of the banks 26L and 26R in the low-speed operation range of the engine E. Therefore, a resonant supercharging effect can be exhibited effectively, thereby increasing the intake air charging efficiency in the low-speed operation range of the engine E to enhance the power output performance.

The on-off valve 75 in the intake air dispensing box 60 is opened in a high-speed operation range of the engine E, whereby the left and right dispensing chambers 63L and 63R communicate with each other through the valve bore 74 to constitute a single surge tank having a larger capacity. Therefore, the resonant effect obtained in the low-speed operation range of the engine E is eliminated, thereby preventing a delay in intake response. As a result, a predetermined intake air charging efficiency can be secured in the high-speed operation range of the engine E, to thereby enhance the power output performance.

Figure 8:
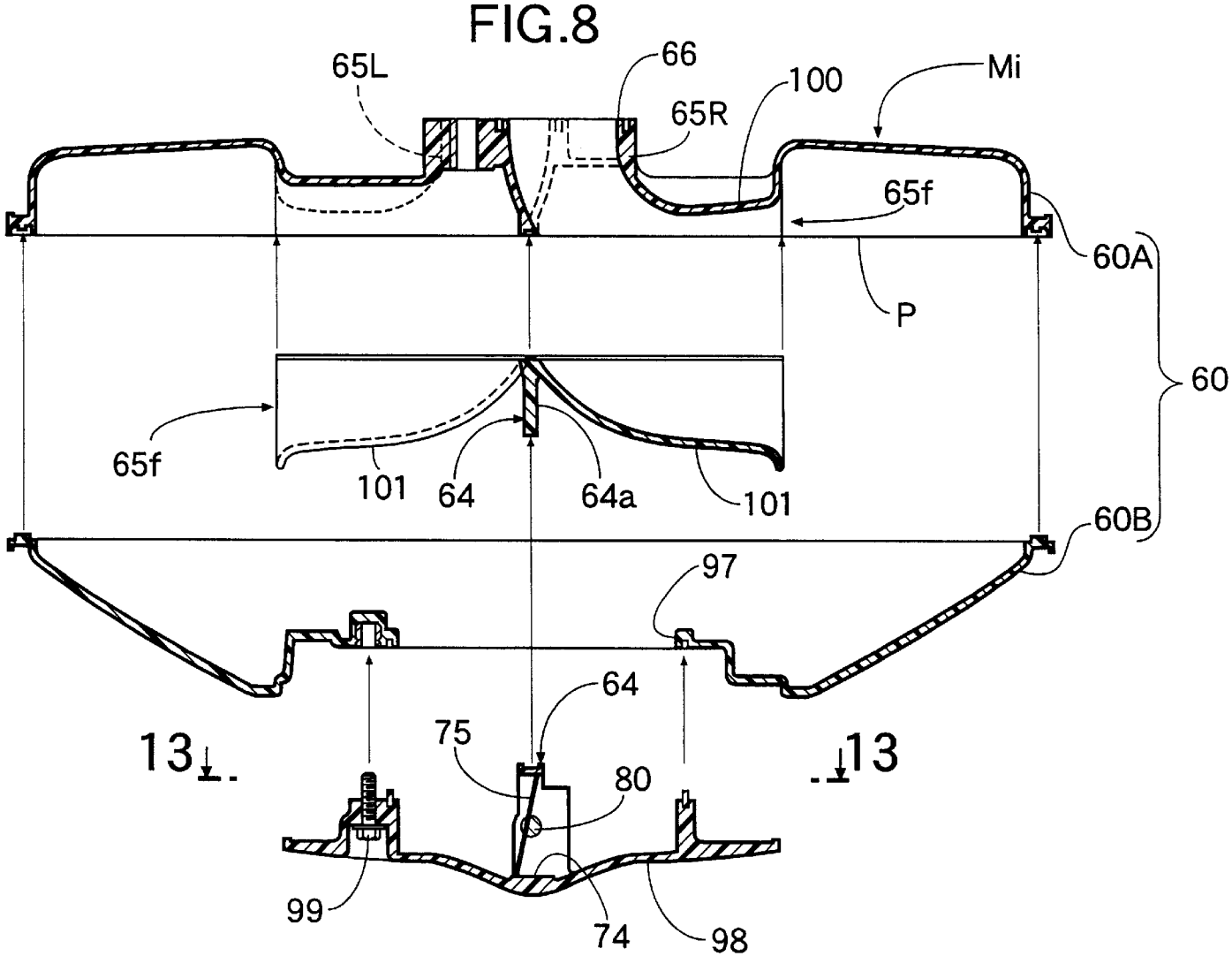
FIG. 8 is an exploded view of an intake manifold, similar to FIG. 7.
Figure 9:
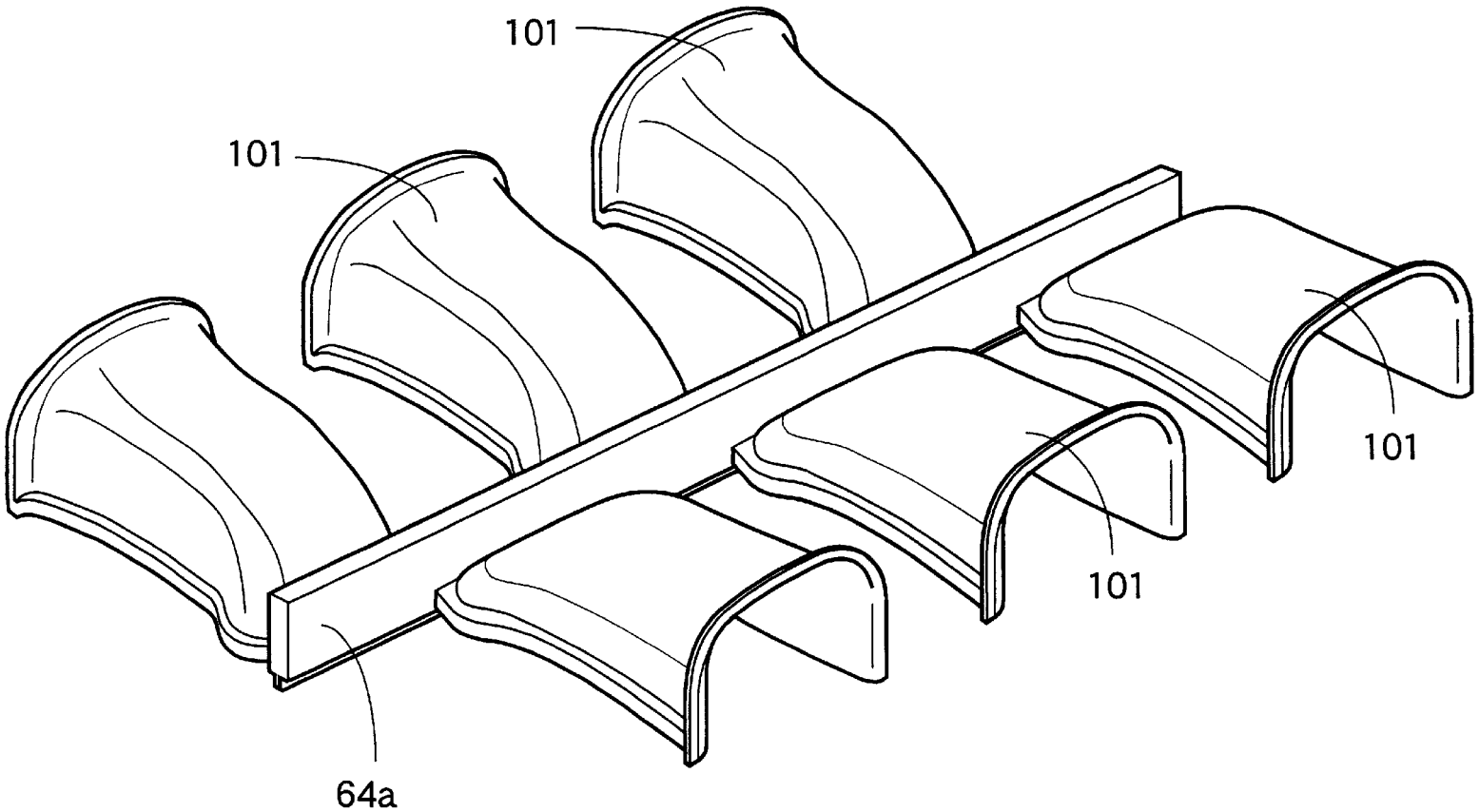
FIG. 9 is a perspective view of a group of funnel segments in the intake manifold.
Figure 10:
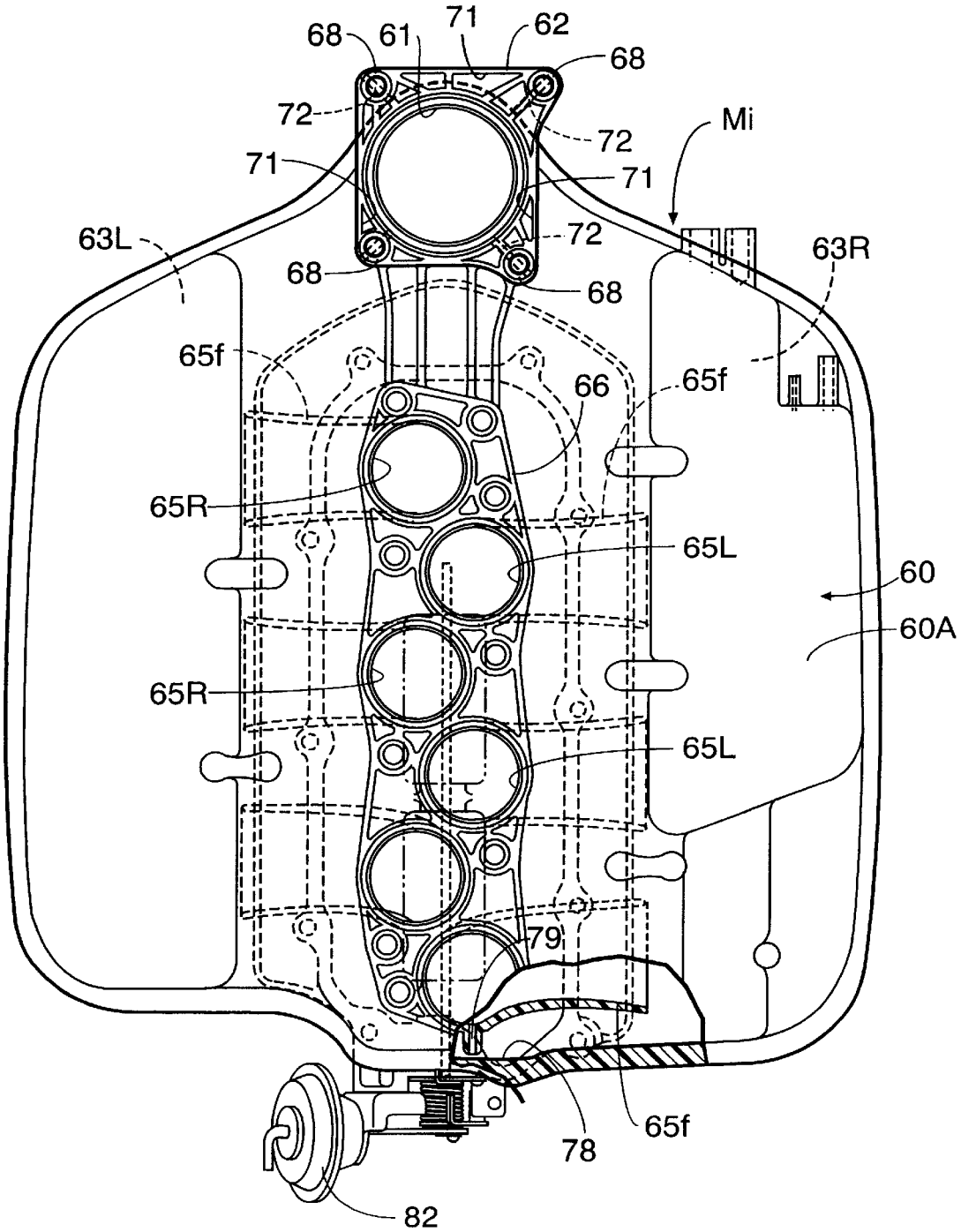
FIG. 10 is a sectional view taken along a line 10—10 in FIG. 7.

Referring to FIG. 8, a fuel sump is provided in the form of a recess 78 on a bottom surface of the intake air dispensing box 60. On the other hand, a fuel draw-up bore 79 is provided in the lowermost funnel 65*f* to extend downwards in order to permit the inner surface of the lowermost funnel 65*f* to communicate with the recess 78. The provision of the recess 78 and the fuel draw-up bore 79 in the above manner ensures that even if fuel has been accumulated in the bottom of the intake air dispensing box 60, i.e., in the fuel sump in the form of the recess 78 by an intake air blow-back phenomenon, the fuel draw-up bore 79, when a negative pressure is generated in the lowermost funnel 65*f*, draws up the fuel by the action of such negative pressure. Thus, the fuel is supplied to the corresponding cylinder bores 28L or 28R and hence, a loss of fuel can be prevented.

In addition, the fuel flowing back from each of the intake air branches 65L and 65R into the intake air dispensing box 60 is reliably retained on the recess 78 serving as the fuel sump and hence, a loss of fuel due to the scattering of the fuel can be also prevented.

The fuel draw-up bore 79 is provided in the funnel 65*f* of lowermost one of the plurality of intake air branches 65L and 65R arranged vertically and hence, the fuel accumulated in the recess 78 can be drawn up with the shortest fuel draw-up bore 79.

Figure 12:
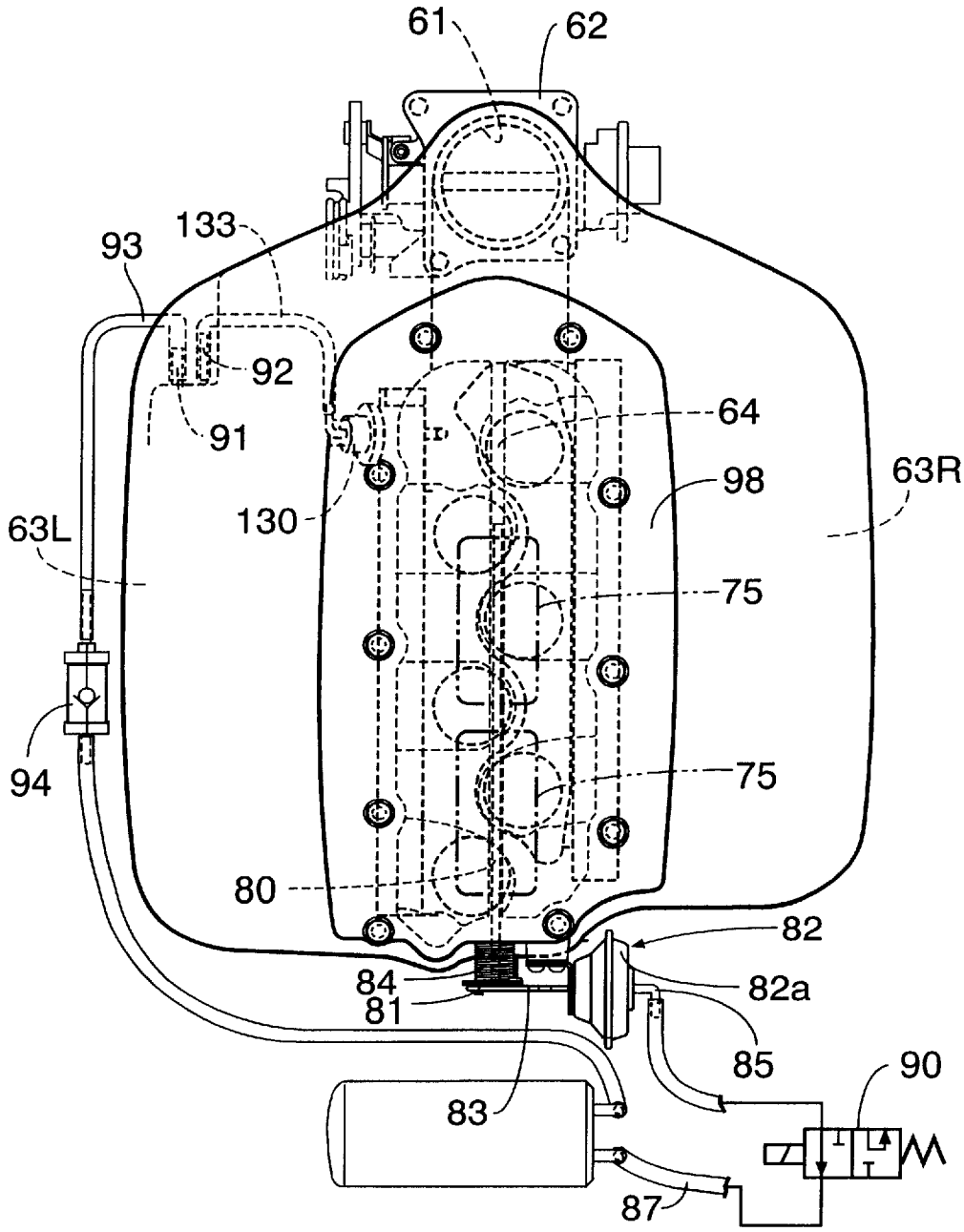
FIG. 12 is a view taken along a line 12—12 in FIG. 7.
Figure 13:
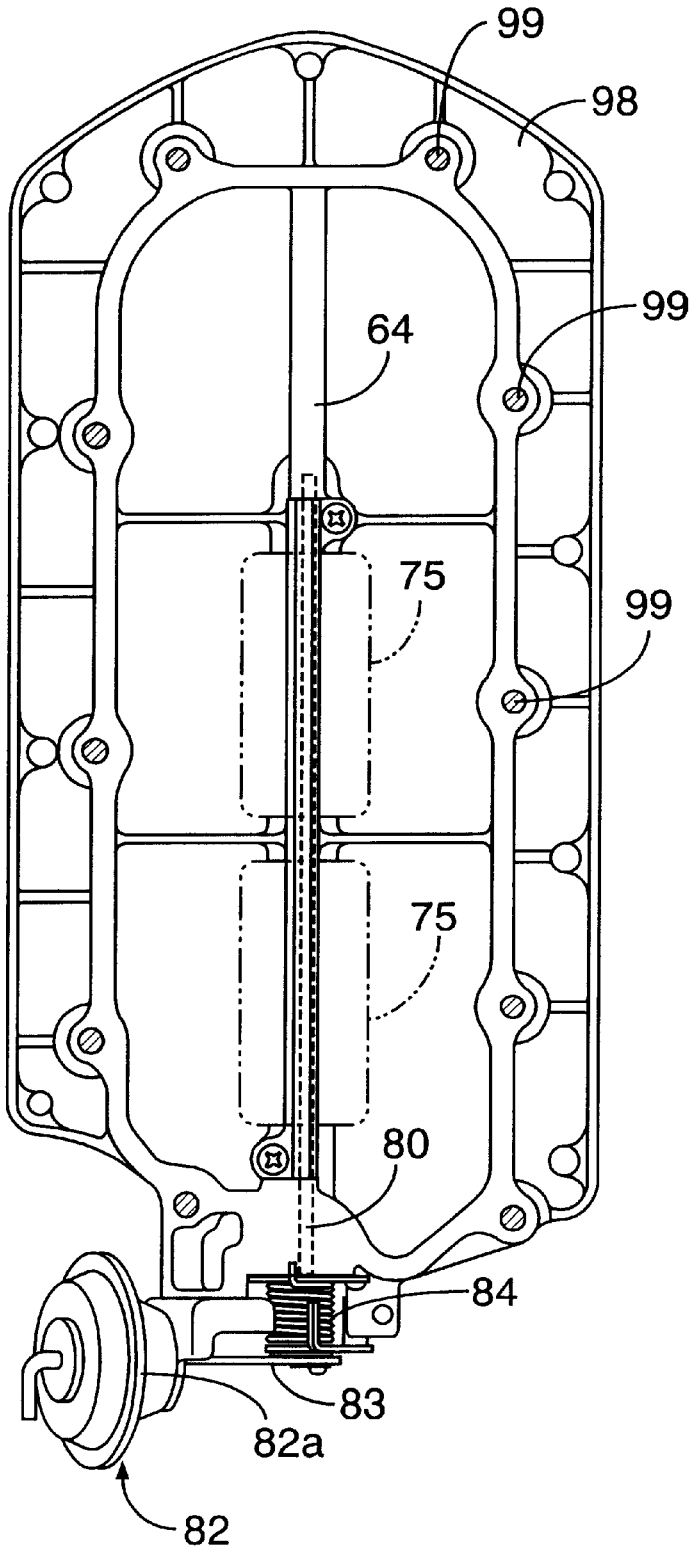
FIG. 13 is a view taken along a line 13—13 in FIG. 2.

Referring to FIGS. 12 and 13, a valve shaft 80 secured to the on-off valve 75 is rotatably carried on the partition wall 64. An operating rod 83 of a negative pressure actuator 82 is connected to an operating lever 81 fixedly mounted at one end of the valve shaft 80. The operating lever 81 is biased by a return spring 84 in a direction to open the on-off valve 75. The negative pressure actuator 82 has a casing 82*a* supported on an outer wall of the intake air dispensing box 60. A diaphragm is mounted in a spreading manner in the casing 82*a* for partitioning a negative pressure chamber and an atmospheric air chamber from each other. When negative pressure is introduced into the negative pressure chamber, the diaphragm is operated to pull the operating rod 83, thereby turning the operating lever 81 in a direction to close the on-off valve 75.

A negative pressure introducing pipe 85 is projectingly provided on the casing 82*a* of the negative pressure actuator 82 and leading to the negative pressure chamber, and a control valve 90 is incorporated in the middle of a negative pressure conduit 87 connecting the negative pressure introducing pipe 85 and a negative pressure tank 86 to each other. The control valve 90 comprises a solenoid valve and is adapted to be exited in the low-speed operation range of the engine E to bring the negative pressure introducing pipe 85 into a communicating state, and to be deexited in the high-speed operation range to bring the negative pressure introducing pipe 85 into a blocked state and to open the negative pressure chamber in the negative pressure actuator 82 into the atmospheric air, by the control operation provided by an electronic control unit (not shown). Therefore, in the low-speed operation range of the engine E, the negative pressure actuator 82 is operated to close the on-off valve 57, and when the engine E is brought into the high-speed operation range, the negative pressure actuator 82 is brought into an inoperative state and hence, the on-off valve 75 is opened by a biasing force of the return spring 84.

A negative pressure conduit 93 leading to a first negative pressure extracting pipe 91 formed at the upper portion of the intake air dispensing box 60 is connected to the negative pressure tank 86, and a check valve 94 is incorporated in the middle of the negative pressure conduit 93 for inhibiting the backflow of the negative pressure from the negative pressure tank 86 toward the intake air dispensing box 60. Therefore, during operation of the engine E, an intake negative pressure generated in the intake air dispensing box 60 can be stored in the negative pressure tank 86 through the negative pressure conduit 93 and the check valve 94.

As shown in FIGS. 2 and 4, the negative pressure tank 86 is disposed in the auxiliary-device space 27 between an upper surface of a rear portion of the mount case 1 and the left and right banks 26L and 26R along with a subsidiary fuel tank 121, which will be described hereinafter.

Referring again to FIGS. 7 to 9, the intake air dispensing box 60 is divided by a vertical plane P into a first box half 60A disposed on a front side, i.e., on the side of the banks 26L and 26R, and a second box half 60B disposed on a rear side. The first and second box halves 60A and 60B are individually formed from a synthetic resin. In this case, the connecting flange 62 having the intake air inlet 61 is formed integrally on the first box half 60A. Parting faces of the first and second box halves 60A and 60B are vibration-welded to each other.

An opening 97 is provided in a central portion of a sidewall of the second box half 60B, and a lid plate 98 for closing the opening 97 is formed of a synthetic resin. In this case, a half of the partition wall 64 is formed integrally on the partition wall 64. The valve bore 74 is formed in this half, and the on-off valve 75 for opening and closing the valve bore 74 is mounted to the half. The lid plate 98 is fastened to the second box half 60B by a bolt 99.

The left and right intake air branches 65L and 65R are comprised of a plurality of intake air branch bodies 100 formed integrally on the first box half 60A and each having a portion of the funnel 65*f*, and funnel segments 101 separated from the intake air branch bodies 100 on the plane P and each forming the remaining portion of the funnel 65*f*. In this case, a connector 64*a* is integrally formed on all the funnel segments 101 to form a portion of the partition wall 64. Namely, a group of the funnel segments 101 and the connector 64*a* are formed integrally with each other.

To assemble the intake manifold Mi, a group of the left and right branch bodies 100 on the first box half 60A and the group of the funnel segments 101 are first superposed on each other, pressed and welded to each other by relatively vibrating them. Then, the first box half 60A and the second box half 60B are likewise superposed on each other on the plane P and vibration-welded to each other. Thereafter, the lid plate 98 is mated and coupled to the second box half 60A by the bolt 99.

In this manner, the first box half 60A, the second box half 60B, the group of the intake branch bodies 100 and the group of the funnel segments 101 are vibration-welded together on the plane P. Therefore, the formation of each of the members can be facilitated, and when they are welded together, the pressing force on all the weld surfaces is equalized reliably, thereby equalizing the weld margin and providing the stabilization of the weld strength. Thus, it is possible to provide enhancements in productivity and quality of the intake manifold Mi. In addition, the plurality of funnel segments 101 are connected integrally with one another by the connector 65*a* which is a portion of the partition wall 64 and hence, the group of the funnel segments 101 can be formed at a stroke along with the connector 64*a*, and the vibration-welding of the funnel segments 101 to the group of the intake branch bodies 100 can be conducted easily.

Moreover, the longitudinally flat intake air dispensing box 60 is disposed in proximity to the rear end faces of the left and right banks 26L and 26R, and the groups of the left and right intake branches 65L and 65R are disposed to protrude into the valley 56 between the left and right banks 26L and 26R. Therefore, the intake manifold Mi can be disposed in a narrow space between the banks 26L, 26R and the rear wall of the engine hood 33, thereby providing an enhancement in space efficiency of the engine room 23 and suppressing an increase in size of the engine hood 33.

The on-off valve 75 is supported on a portion of the partition wall 64 integral with the lid plate 98. Therefore, the intake air dispensing box 60 provided with the on-off valve 75 can be assembled with a good efficiency by securing the lid plate 98 to the intake air dispensing box 60 after the formation of an assembly comprising the lid plate 98 and the on-off valve 75.

Figure 11:
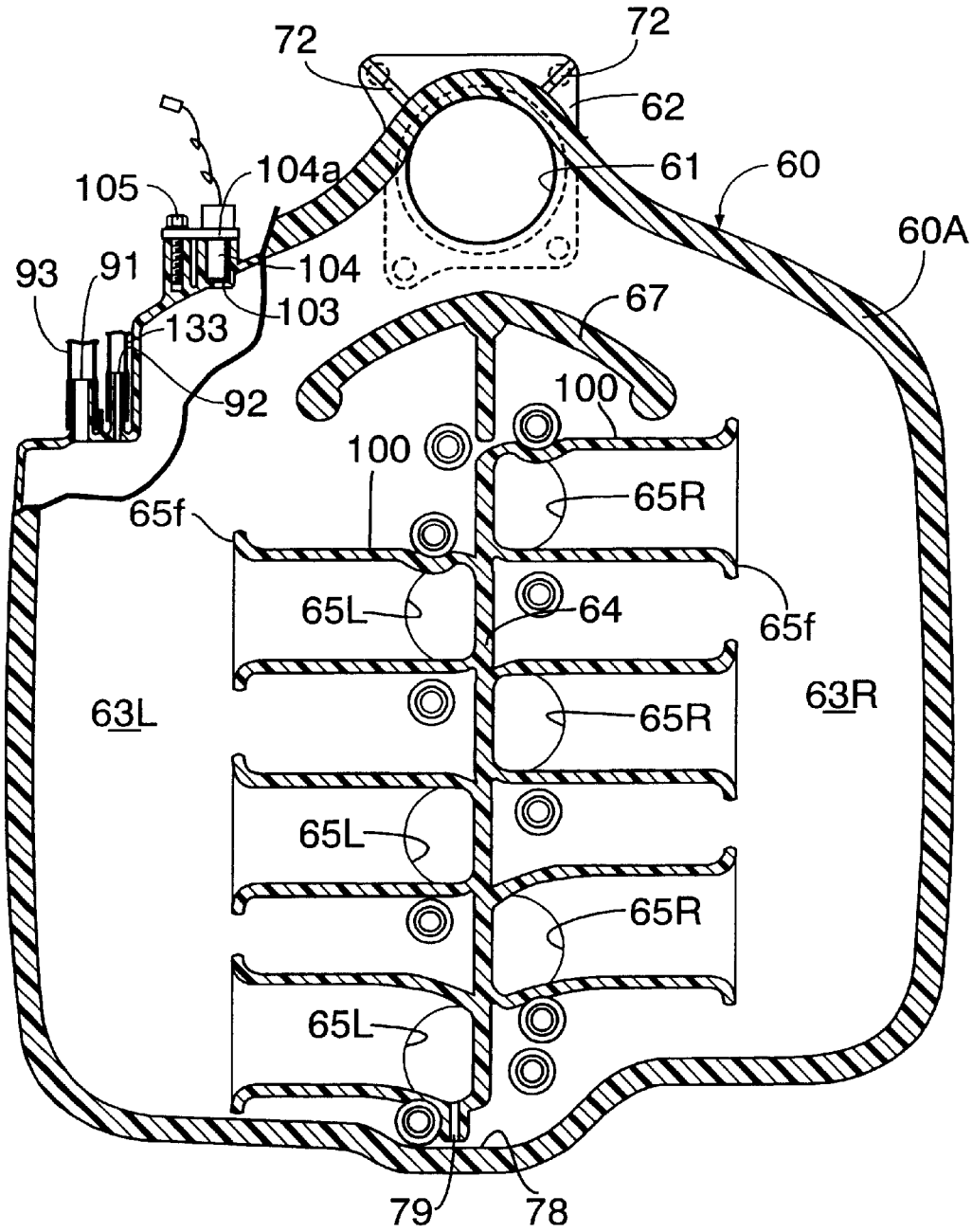
FIG. 11 is a sectional view taken along a line 11—11 in FIG. 7.

Referring to FIG. 11, a negative pressure-detecting bore 103 is provided in an upper wall of the intake air dispensing box 60 to open into the air dispensing box 60, and an intake negative pressure sensor 104 is fitted into the negative pressure detecting bore 103. A mounting plate 104*a* included in the intake negative pressure sensor 104 is secured to the upper wall of the intake air dispensing box 60 by a bolt 105. A lead wire leading to an electronic control unit (not shown) controlling the amount of fuel injected into the engine and the ignition timing and the like, is connected to an output terminal of the intake negative pressure sensor 104. Therefore, an intake negative pressure detected by the intake negative pressure sensor 104 is used to control the amount of fuel injected into the engine, the ignition timing and the like.

The intake negative pressure sensor 104 fitted in the negative pressure detecting bore 103 directly detects an intake negative pressure generated in the intake manifold Mi and hence, the responsiveness of the intake negative pressure sensor 104 to a fluctuation in intake negative pressure in the engine can be enhanced. Further, the inside of the intake manifold Mi has a function as a surge tank, and smoothens the pulsation of intake air in the engine and hence, the intake negative pressure sensor 104 can detect a correct intake negative pressure. Moreover, a conventional long negative pressure conduit is not required and hence, enhancements in assemblability and maintenance of the engine can be brought about.

The lead wire connected to the intake negative pressure sensor 104 is extremely short and hence, cannot impede the assemblability and maintenance of the engine.

A fuel supply system will be described below with reference to FIGS. 7 and 14 to 16.

Solenoid-type fuel injection valves 110L and 110R are mounted to the intake pipes 58L and 58R of the left and right banks 26L and 26R for injecting fuel toward the intake valves of the corresponding banks 26L and 26R. A longitudinally long left fuel rail 111L is mounted on the plurality of left fuel injection valves 110L for supplying the fuel to the left fuel injection valves 110L, and a longitudinally long right fuel rail 111R is mounted on the plurality of right fuel injection valves 110R for supplying the fuel to the right fuel injection valves 110R. The left and right fuel rails 111L and 111R are connected at lower ends to each other by a communication pipe 112.

A primary fuel pump 113 is placed on one of the head covers 30L and mechanically driven by the camshaft 6L. A first fuel pipe 114 connected to a suction port in the primary fuel pump 113 is connected through a joint 115 to a fuel discharge pipe 117 extending from a fuel tank 116 placed on the side of the hull H. A first fuel filter 118 and a second fuel filter 119 are sequentially, from the upstream side, incorporated in the middle of the first fuel pipe 114. The first fuel filter 118 removes water from the fuel, and the second fuel filter 119 remove other foreign matters from the fuel.

A discharge port in the primary fuel pump 113 is connected to a fuel inlet in a subsidiary fuel tank 121 through a second fuel pipe 120. A known float valve is mounted within the subsidiary fuel tank 121 and adapted to close the fuel inlet when the oil level of the fuel in the subsidiary fuel tank 121 rises to a predetermined level or more. Therefore, during operation of the engine E, a given amount of fuel pumped from the main fuel tank 116 by the primary fuel pump is stored. A secondary fuel pump 122 is mounted to one side of the subsidiary fuel tank 121 for pumping out the fuel in the tank 121, and has a discharge port connected to an upper end of the right fuel rail 110L through a third fuel pipe 123. Therefore, a high-pressure fuel discharged from the secondary fuel pump 122 fills the right fuel rail 111R from its upper end, then passes through the communication pipe 112 to fill left fuel rail 111L from its lower end, and is supplied to each of the fuel injection valves 110L and 110R. In this way, the left and right fuel rails 111L and 111R and the communication pipe 112 define a U-shaped fuel passage by cooperation with each other and hence, it is difficult for air bubbles to reside in the fuel passage, and it is possible to stabilize the amount of fuel injected from each of the fuel injection valves 110L and 110R.

Figure 16:
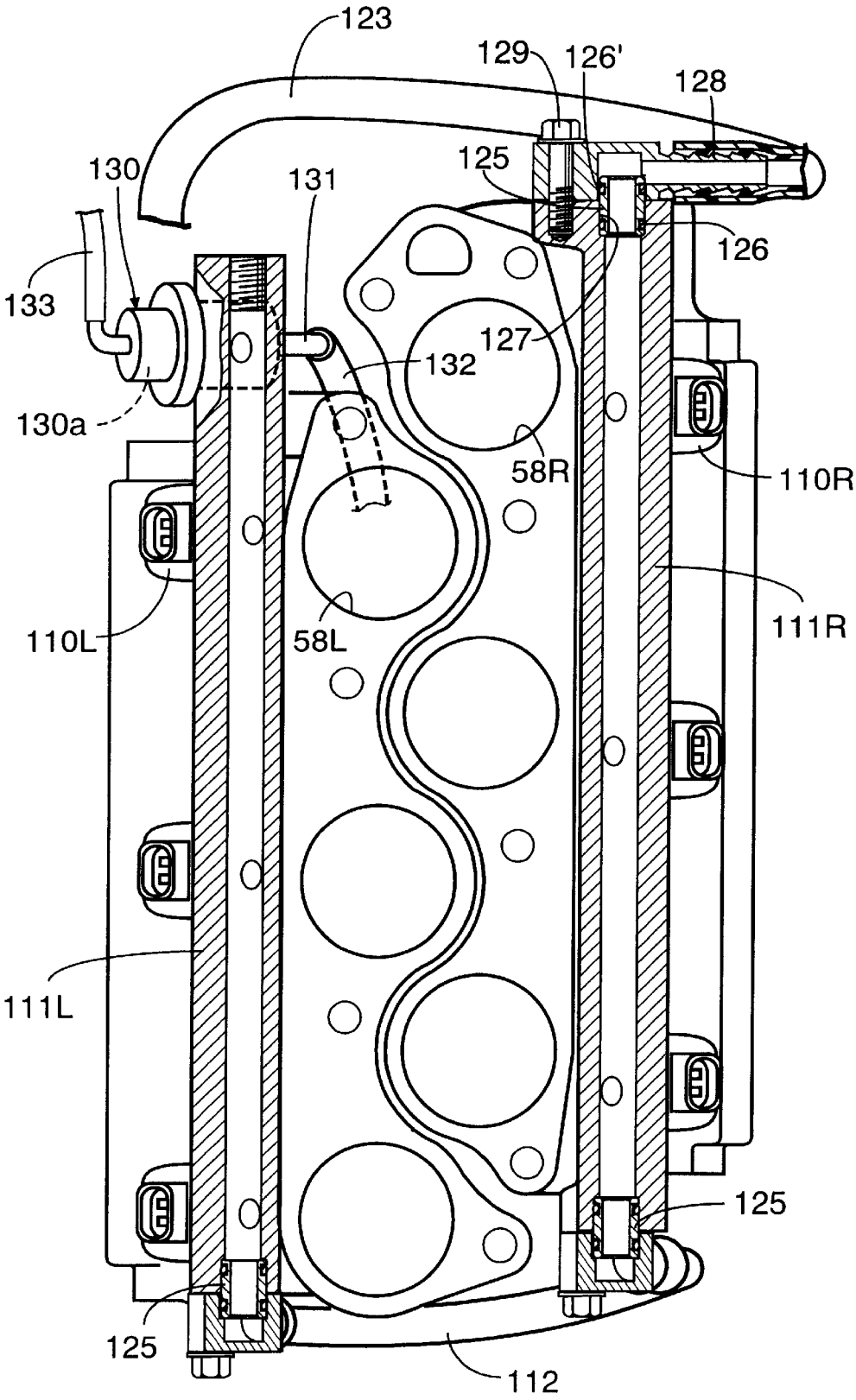
FIG. 16 is a vertical sectional view of fuel rails.

Joints 125 as shown in FIG. 16 are used to connect the fuel rails 111L and 111R with the third fuel pipe 123 and the communication pipe 112. More specifically, each of the joints 125 is of a hollow cylindrical shape, and a pair of seal members 126 and 126' are mounted on an outer periphery of each of the joints 125 at its opposite ends. One end of the joint 125 is fitted into an enlarged bore 127 at an end of each of the fuel rails 111L and 111R, so that one of the seal member 126 is brought into close contact with an inner peripheral surface of the enlarged bore 127, and the other end of the joint 125 is fitted in a terminal pipe 128 connected to ends of the third fuel pipe 123 and the communication pipe 112, so that the other seal member 126' is brought into close contact with an inner peripheral surface of the terminal pipe 128. The terminal pipe 128 has a mounting plate 128*a* which is secured to the corresponding fuel rail 111L, 111R by a bolt 129. By adopting such a connecting structure, the connection of the fuel rails 111L and 111R with the third fuel pipe 123 and the communication pipe 112 can be conducted simply and reliably.

An upper end of the left fuel rail 111L is closed, and a fuel pressure regulator 130 is mounted at the upper end of the left fuel rail 111L. The fuel pressure regulator 130 regulates the pressures in the fuel rails 111L and 111R, i.e., the pressures of fuel injected from the fuel injection valves 110L and 110R. A fuel return pipe 132 is connected to a surplus fuel outlet pipe 131 of the fuel pressure regulator 130, and opens at its terminal end into the subsidiary fuel tank 121. Therefore, the fuel determined to be surplus by the fuel pressure regulator 130 is returned through the fuel return pipe 132 to the subsidiary fuel tank 121. The fuel pressure regulator 130 has a negative pressure chamber 130*a* for controlling the pressure of fuel injected in accordance with the intake negative pressure in the engine, i.e., the load, and the second intake negative pressure extracting pipe 92 (see FIG. 11) of the intake air dispensing box 60 is connected to the negative pressure chamber 130*a* through a negative pressure conduit 133.

An air vent pipe 134 is connected to a ceiling wall of the subsidiary fuel tank 121 to communicate with a space over a fuel level in the subsidiary fuel tank 121. The air bent pie 134 once extends upwards, bends in an inverted U-shape at an upper portion of the engine E, and then opens into the annular empty chamber 24 (see FIG. 5) in the undercover 22. A fuel vapor trap 135 comprising a filtering material is incorporated in an air-rising route in the air vent pipe 134.

The inside of the subsidiary fuel tank 121 is breathed through the air vent pipe 134, and the fuel vapor generated in the subsidiary fuel tank 121 at that time is captured in the fuel vapor trap 135, where the fuel is liquefied and returned to the subsidiary fuel tank 121.

The subsidiary fuel tank 121 and the secondary fuel pump 122 are supported on a plurality of support pillars 136 projectingly provided on the upper surface of the mount case 1 through brackets 137 in the auxiliary-device space 27 (see FIGS. 2 and 14), and the negative pressure tank 86 is supported on the rear surface of the subsidiary fuel tank 121 through a bracket 138.

Although the embodiments of the present invention have been described in detail, it will be understood that the present invention is not limited to the above-described embodiment, and various modifications in design may be made without departing from the spirit and scope of the invention defined in the claims.

What is claimed is:

1. An intake system in a V-type 4-stroke engine for an outboard engine system, said engine including a crankshaft disposed vertically, and cylinder heads of left and right banks disposed to face rearwards, and an engine hood covering said engine, wherein said intake system comprises an intake air inlet which is provided in an upper portion of a longitudinally flat intake air dispensing box disposed between said cylinder heads and a rear wall of said engine hood and which leads to an intake passageway in a throttle body, the inside of said intake air dispensing box being divided by a partition wall into first and second dispensing chambers each communicating with said intake air inlet and extending longitudinally; and an on-off valve mounted on said partition wall and capable of bringing said first and second dispensing chambers into and out of communication with each other, and wherein each of said left and right banks has an intake port which communicates with said first and second dispensing chambers.

2. An intake system in a V-type 4-stroke engine for an outboard engine system according to claim 1, wherein an opening is provided in one sidewall of said intake air dispensing box; a lid plate having said partition wall is secured to said intake air dispensing box to close said opening; and said on-off valve is mounted to said partition wall of said lid plate.

3. An intake system for a V-type 4-stroke engine for an outboard engine system according to claim 1 or 2, wherein said intake air dispensing box having said intake air inlet is formed of a synthetic resin, a plurality of intake branches made of a synthetic resin and leading at their downstream ends to a plurality of intake ports in the engine are connected to the sidewall of said intake air dispensing box, funnels are formed at the upstream ends of said intake branches and disposed within said intake air dispensing box, thereby constructing an intake manifold;

said intake air dispensing box are comprised of a first box half and a second box half welded to each other on one plane, said intake air inlet being provided in one of said box halves; and said plurality of intake branches are comprised of a plurality of intake branch bodies integrally formed on said first box half and each having a portion of each of said funnels, and a plurality of funnel segments welded to said intake branch bodies on one plane in said intake air dispensing box and each constituting the remaining portion of each of said funnels.

4. An intake manifold in a V-type 4-stroke engine according to claim 3, wherein a connector is integrally formed on said plurality of funnel segments and connects said funnel segments together.

5. An intake system in a V-type 4-stroke engine for an outboard engine system according to claim 3, wherein a plane on which said first and second box halves are welded to each other and a plane on which said intake branch bodies and said funnel segments are welded to each other, are disposed on one plane.

* * * * *